US006881163B2

(12) United States Patent
Schroeder et al.

(10) Patent No.: US 6,881,163 B2
(45) Date of Patent: Apr. 19, 2005

(54) PORTABLE BASKETBALL STAND

(75) Inventors: Edward A. Schroeder, Marengo, IL (US); Randolph J. Mical, Oak Lawn, IL (US)

(73) Assignee: Porter Athletic Equipment Company, Broadview, IL (US)

( * ) Notice: Subject to any disclaimer, the term of this patent is extended or adjusted under 35 U.S.C. 154(b) by 51 days.

(21) Appl. No.: 10/365,340

(22) Filed: Feb. 12, 2003

(65) Prior Publication Data

US 2004/0157688 A1 Aug. 12, 2004

(51) Int. Cl.[7] ..... A63B 63/08
(52) U.S. Cl. ..... 473/481; 473/476
(58) Field of Search ..... 473/479, 483, 473/484, 486, 472, FOR 100, 476, 481; 248/188.1, 188.2, 188.3, 188.4, 188.5, 188

(56) References Cited

U.S. PATENT DOCUMENTS

| | | | | |
|---|---|---|---|---|
| 3,137,502 A | | 6/1964 | Duganich | |
| 3,427,025 A | | 2/1969 | Porter | |
| 3,841,631 A | | 10/1974 | Dolan | |
| 4,412,679 A | * | 11/1983 | Mahoney et al. | 473/483 |
| 5,100,132 A | | 3/1992 | Anderson | |
| 5,628,508 A | | 5/1997 | Koole | |
| 2001/0045498 A1 | | 11/2001 | Davis et al. | |
| 2003/0040383 A1 | | 2/2003 | Squibb | |

OTHER PUBLICATIONS

Basketball Products International, Inc., 95–96 Product Catalog, pp. 38–40, Jun. 1995.
Portable Basketball Systems Catalog, Schelde North America (2002).

* cited by examiner

*Primary Examiner*—Gregory Vidovich
*Assistant Examiner*—M. Chambers
(74) *Attorney, Agent, or Firm*—Barnes & Thornburg

(57) ABSTRACT

A portable basketball stand apparatus includes a frame member for supporting a backboard and rim assembly, a base member for supporting the frame member, and wheels that allow the base member to move over a supporting surface. A reciprocating actuator displaces the frame member between a storage position and a playing position. One or more front wheels lie adjacent the front or first end of the base member, the end most proximate the backboard and rim assembly when the frame extends to the playing position. These front wheels move relative to the base member between a lowered position in which the base member lies above the supporting surface and a raised position in which the base member engages the supporting surface.

19 Claims, 5 Drawing Sheets

PORTABLE BASKETBALL STAND

BACKGROUND OF THE INVENTION

1. Field of the Invention

The present invention relates to a basketball stand, and more particularly to a basketball stand that supports a backboard and rim assembly and includes a base and frame for supporting the assembly.

2. Description of Related Art

The prior art includes a variety of portable basketball stands that support backboards and rim assemblies a predetermined distance above a playing surface. For example, U.S. Pat. No. 5,628,508 to Koole describes a portable basketball stand, including a base, a support system, a set of springs, and an assembly of cams, rods and laths that co-operate with the springs and the support system to lift at least part of the weight of the stand from the playing surface and render the stand stationary.

A portable basketball stand should have a simple and reliable construction that minimizes the cost of fabrication and assembly and allows easy operation and portability. The prior art, however, includes devices with complex constructions and a multiplicity of moving parts and co-operating components. Unlike these prior devices, the portable basketball stand of the present invention is a simple and durable construction that facilitates portability, reduces the costs of manufacture and assembly, and provides consistent and reliable performance.

SUMMARY OF THE INVENTION

In accordance with one embodiment of the present invention, a portable basketball stand comprises a frame member for supporting a backboard and rim assembly, a base member for supporting the frame member, and wheels that allow the base member to move over a supporting surface. A reciprocating actuator displaces the frame member between a storage position and a playing position. One or more front wheels lie adjacent the front or first end of the base member, the end most proximate the backboard and rim assembly when the frame extends to the playing position. This front wheel or wheels move relative to the base member between a lowered position in which the base member lies above the supporting surface and a raised position in which the base member engages the supporting surface.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are necessary for an understanding of the present invention.

DETAILED DESCRIPTION OF THE DRAWINGS

Figure 1:
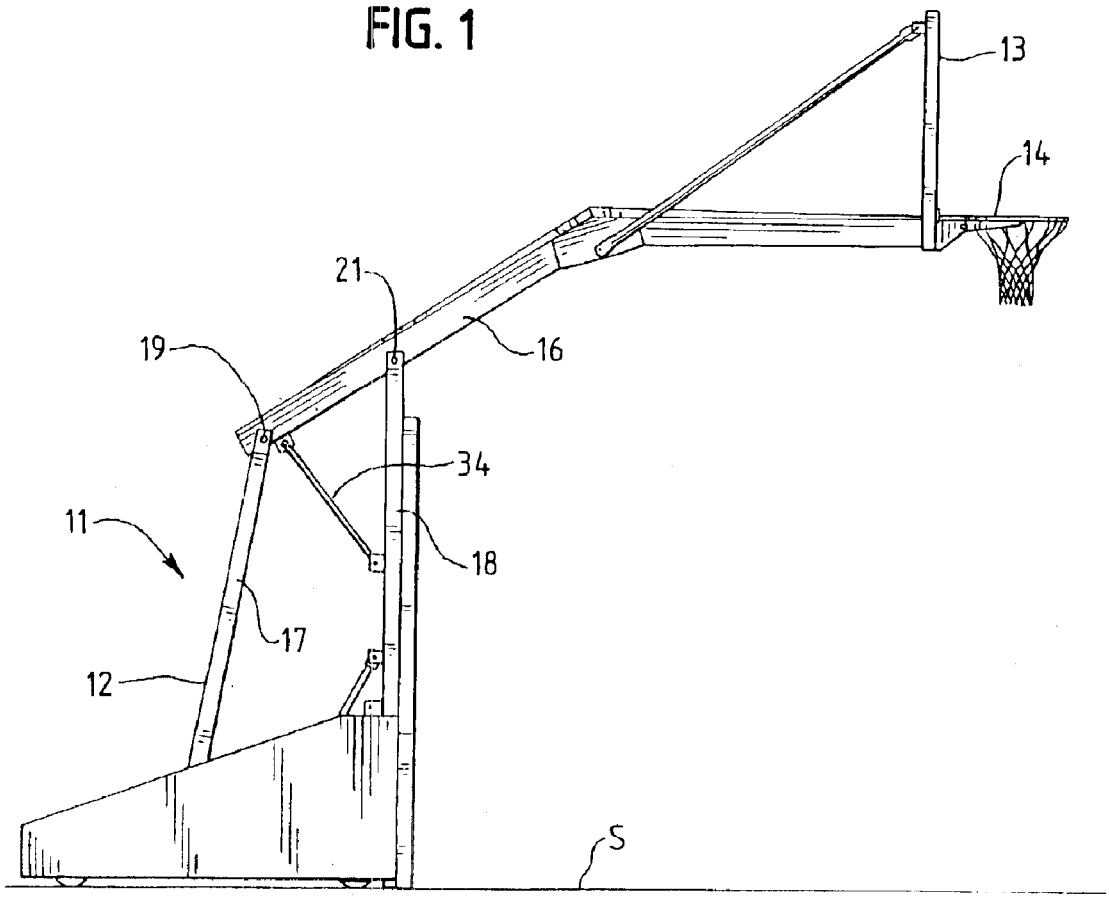
FIG. 1 is a side elevation view of the basketball stand of the present invention, showing the stand in a first, playing position supporting a backboard and rim assembly.
Figure 4:
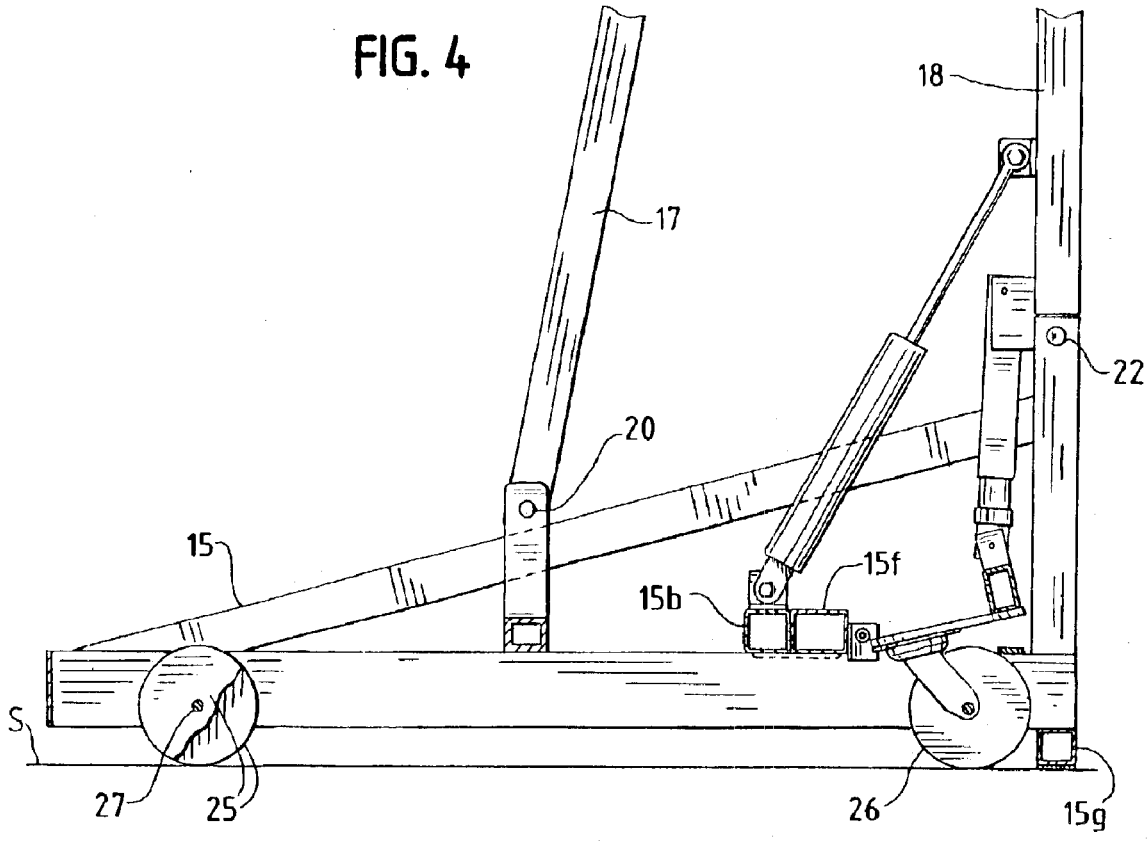
FIG. 4 is a sectional view taken along line 4—4 in FIG. 2, showing the stand of the present invention in a playing position.
Figure 5:
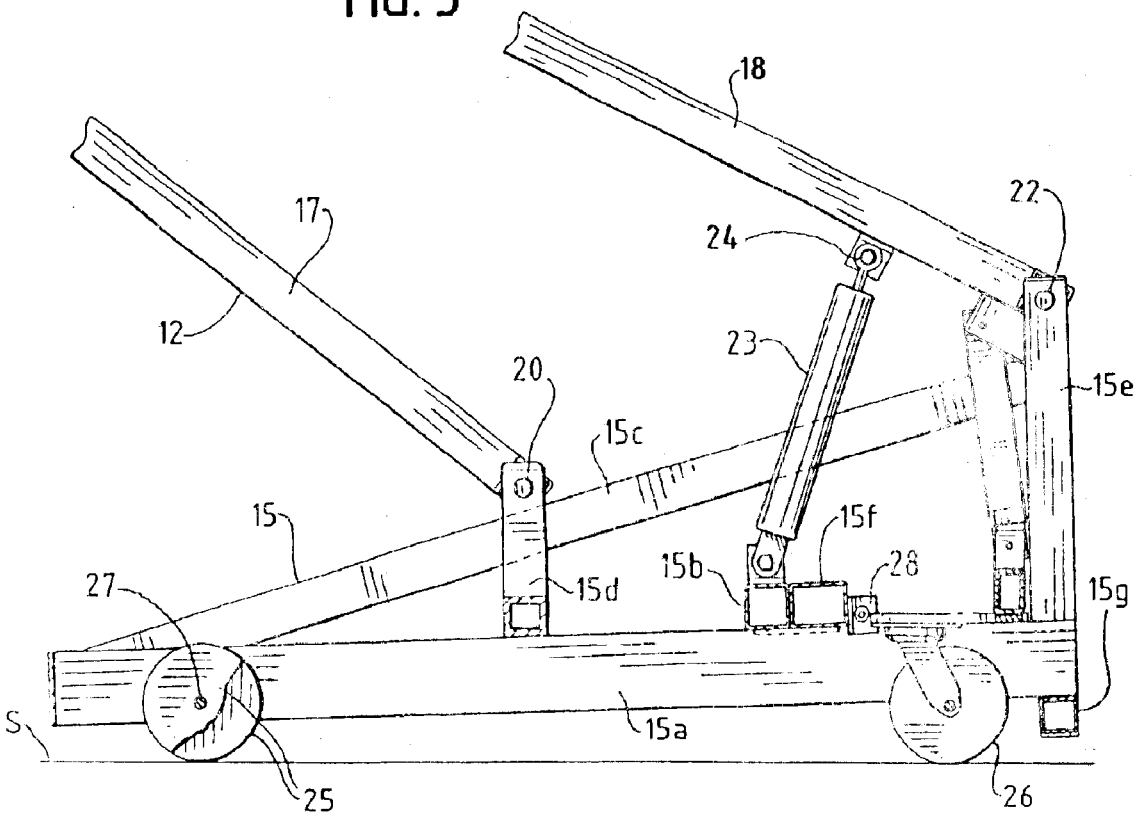
FIG. 5 is the sectional view of FIG. 4, showing the stand of the present invention in the storage position.

Turning now to the drawings and referring specifically to FIG. 1, the portable basketball stand of the present invention 11 generally includes a frame member 12 for supporting a backboard 13 and a rim 14 and a base member 15 for supporting the frame member (See FIGS. 4 and 5). The stand 11 supports the backboard 13 and the rim 14 a predetermined distance above a playing surface in a cantilever fashion; and it retracts to a second configuration to facilitate its storage and transport. The components of the portable basketball stand are made of steel or any other suitable material of high strength and rigidity.

Figure 2:
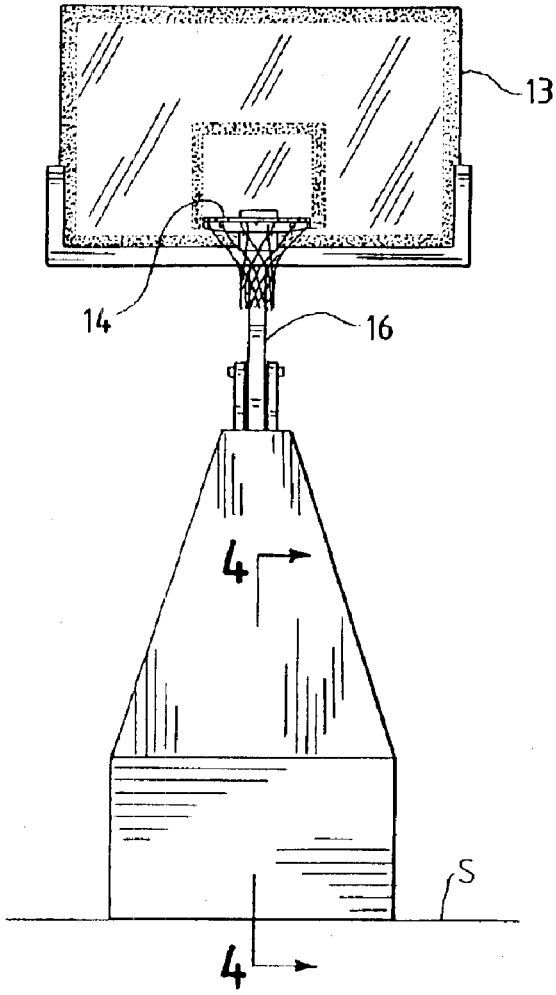
FIG. 2 is a front elevation view of the stand and the backboard and rim assembly of FIG. 1.
Figure 3:
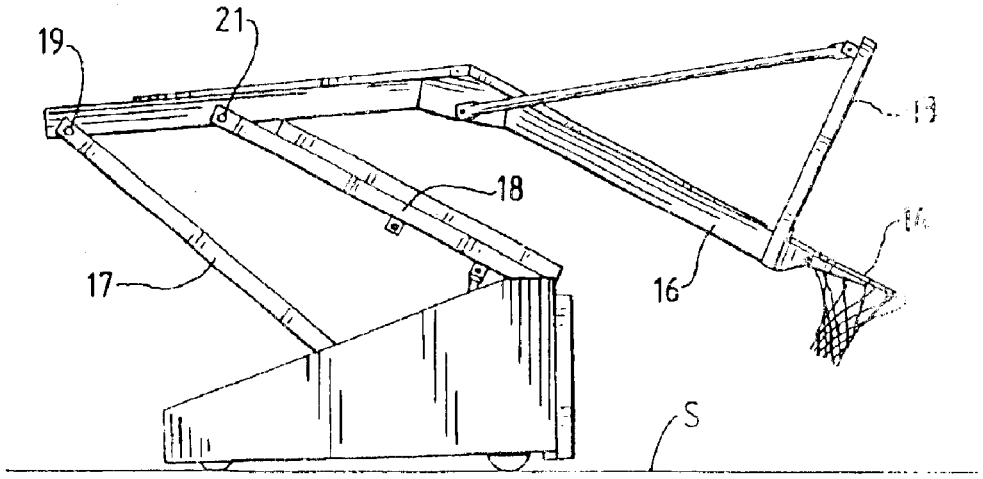
FIG. 3 is a side elevation view of the stand and the backboard and rim assembly of FIG. 1, showing the stand in a second, storage position.
Figure 8:
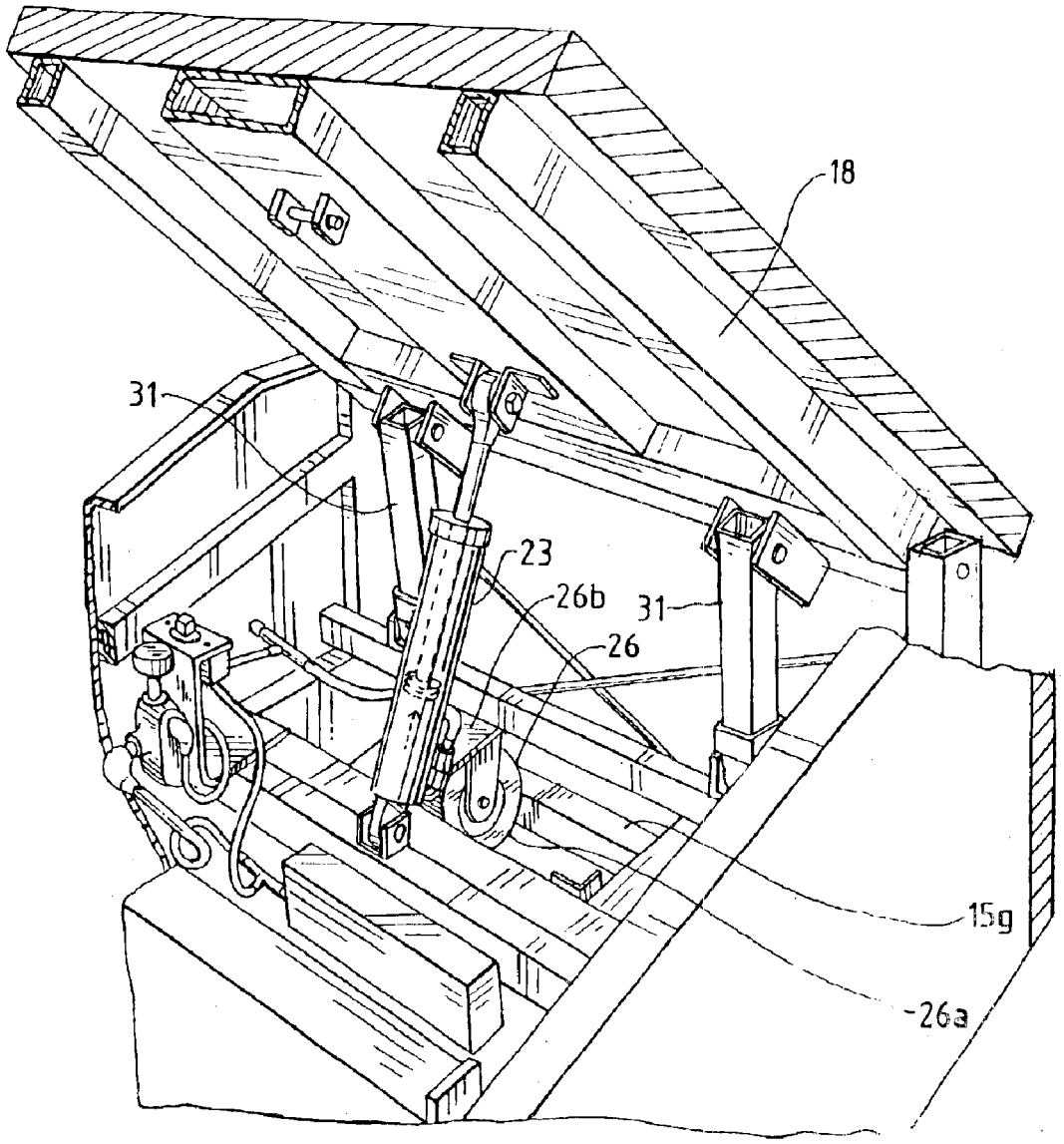
FIG. 8 is a partial perspective view of the basketball stand of the present invention.

The frame member 12 includes a beam element 16 and two leg elements 17 and 18. The beam element 16 is an elongate component with an angled profile, a first end portion which receives the backboard 13 and the rim 14, and an opposite, second end portion which connects to the leg elements 17 and 18. The leg element 17 includes two parallel segments and lies pivotally connected at one of its distal ends to the distal end of the first end portion of the beam element 16, as at 19, and at its opposite distal end to the base member 15, as at 20, in the mid-section of the base member 15. The leg element 18 comprises a generally triangular lattice-type structure (see FIG. 8) that lies pivotally connected at one of its distal ends to the beam element 16, as at 21, a pivot point spaced inwardly of the pivot point 19. At its opposite end, the leg element 18 lies pivotally connected to the base member 15, as at 22, at the front end of the base member 15. The pivot points 19–22 define four pivot axes that lie parallel to one another. Thus, the beam element 16, the leg elements 17 and 18 and the base member 15 form a system of supports which allows the beam element 16 to move from the storage/transport position shown in FIGS. 3 and 5 to the playing position show in FIGS. 1, 2 and 4.

The base member 15 is a platform-like structure with longitudinal elements 15*a*, transverse elements 15*b*, cross-bracing 15*c* and vertical elements 15*d* and 15*e* that pivotally connect to leg elements 17 and 18, respectively. All of these elements are welded or otherwise fixedly secured to one another. The base member 15 supports the frame member 12 (including the backboard 13 and the rim 14), and it supports a hydraulic cylinder assembly 23 (including a pump, motor, tubing and appropriate controls, See FIG. 8) which lies pivotally connected at one end to the base member 15 and at the other, opposition end (the distal end of the cylinder's piston) to the leg element 18, as at 24. The hydraulic cylinder 23 drives the frame member 12 between the storage/transport position of FIGS. 3 and 5 to the playing position of FIGS. 1, 2 and 4.

The base member 15 (and thus the stand 11) rides on two pairs of rear wheels 25 and a pair of front caster assemblies 26. The rear wheels 25 rotate about an axis of rotation defined by an axle 27 which extends transversely across the rear end portion of the base member 15 and rotatably mounts the wheels 25 to the base member 15. Each caster assembly 26 lies pivotally mounted to a transverse element 15*f* of the base member 15, as at 28, so that it may move between the lowered position shown in FIG. 5 and the raised or retracted position shown in FIGS. 4 and 6. In the lowered position, the wheels 25 and the casters 26 engage a supporting surface S, raise and support the front transverse element 15*g* spaced from the surface S, and roll over surface S. In the raised position of the caster assemblies 26, the front transverse element 15*g* (including a bottom contact pad made of rubber or any other suitable non-skid material) engages the supporting surface S to render the stand 11 stationary in the playing position. In both the raised and lowered positions, the caster assemblies remain in contact with the supporting surface S.

Figures 6, 7:
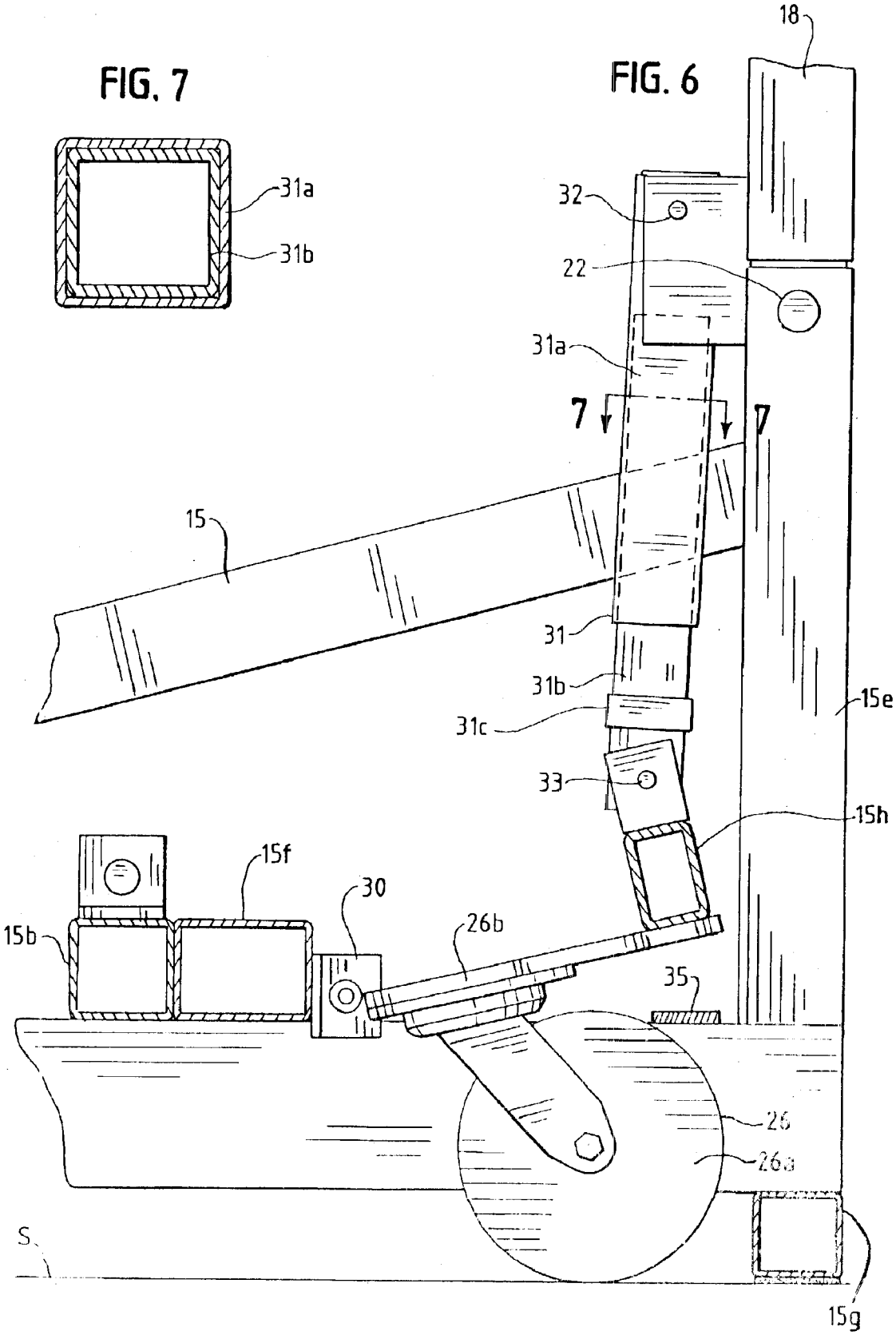
FIG. 6 is a partial enlarged view of the sectional view of FIG. 4.
FIG. 7 is a sectional view taken along line 7—7 in FIG. 6.

Each caster assembly 26 includes a swivelled wheel 26*a* and a mounting plate 26*b*. (See FIG. 6). A pivot connection 30 connects one end of the mounting plate 26*b* to the transverse element 15*f* and a linkage assembly 31 connects an opposite end of the mounting plate 26*b* to the leg element 18 of the frame member 12. (The stand 11 includes two linkage assemblies 31 as well as two caster assemblies 26, See FIG. 8). The linkage assemblies 31 transmit the movement of the frame member 12 to the caster assemblies 26 as the frame moves from the playing configuration to the storage/transport configuration. Each linkage assembly 31 includes an outer tube 31*a* and an inner tube 31*b* disposed in telescoping relation with each other (See FIG. 7). A pivot connection 32 connects the outer tube 31*a* to the leg element 18; and a pivot connection 33 connects the inner tube 31*b* to the mounting plate 26*b* of the caster assembly 26 through a transverse member 15*h* that connects the mounting plates 26*b* of the two caster assemblies 26. The linkage assembly 31 produces an over-center connection at 33, as shown in FIGS. 4–6. Thus, the caster assemblies 26 are locked in FIG. 5 for travel, while allowed to move in FIG. 4.

The hydraulic cylinder 23 drives the frame member 12 from the storage/transport position to the playing position. Specifically, the cylinder 23 drives the leg element 18 to the playing position shown in FIGS. 4 and 6, generally perpendicularly to the supporting surface S. As the leg element 18 pivots upwardly, the caster assemblies 26 pivot upwardly (or rotate in a counter-clockwise manner) as the linkage release them from the lower position until the contact pad of the transverse element 15*g* engages the surface S. In this position, an operator may releasably secure a cross-brace 34 between the leg element 18 and the beam element 16 to further secure the frame member 12 in the playing position. (See FIG. 1)

To return the frame member 12 to the storage/transport position, the operator disengages the cross brace 34 and releases the cylinder 23 to allow the leg element 18 to pivot downwarkly towards the base member 15. The linkage assembly 31 transmits this movement to the caster assemblies 26 and drives the caster assemblies downwardly (to the position shown in FIG. 5) until the mounting plate 26*b* of each caster assembly engages a stop 35 on the base member 15. The outer tube 31*a* of each linkage assembly 31 also engages a stop 31*c* on the inner tube 31*b*.

In the lowered position shown in FIG. 5, the swivelled wheels 26*a* of the caster assemblies 26 engage the supporting surface S, raise the base element 15*g* and lie below the base member 15. This allows the base member 15 to ride on the rear wheels 25 and the swivelled front wheels 26*a*. Although the embodiment shown includes two rear wheels 25 and two front swivelled wheels 26*a*, the stand 11 may alternatively include fewer than four rear wheels or more than four wheels. And, it may include only one front caster assembly or more than two front caster assemblies.

While the above description and the drawings disclose and illustrate one embodiment, one should understand, of course, that the invention is not limited to this embodiment. Those skilled in the art to which the invention pertains may make other modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claim is:

1. A basketball stand comprising: a frame member including a beam for supporting a backboard and rim assembly; a base member for supporting the frame member; the frame member being moveable between a storage position and a playing position; a reciprocating actuator for displacing the frame between the storage position and the playing position; the backboard and rim assembly being disposed outwardly of a first end portion of the base member when the frame lies in the playing position; a first wheel means disposed adjacent the first end portion of the base member; and a second wheel means disposed adjacent a second end portion of the base member; the first wheel means including a plate pivotally mounted to the base at a first end and being moveable between a lowered position in which the base member lies above a supporting surface to allow the basketball stand to roll over the supporting surface and a raised position in which the base member engages the supporting surface and the frame member lies in the playing position; a linkage means connecting a second end of the plate to the frame for transmitting movement of the frame to the first wheel means; and the second wheel means including at least one wheel rotatable about an axis of rotation fixed with respect to the base member.

2. The basketball stand of claim 1, wherein the first wheel means includes at least one caster assembly.

3. The basketball stand of claim 1, wherein the first wheel means includes first and second wheel assemblies pivotally mounted to the base member.

4. The basketball stand of claim 3, including a connecting element connecting the first and second wheel assemblies and the linkage means is connected to the connecting element.

5. The basketball stand of claim 3, wherein the first and second wheel assemblies each include a rotatable caster.

6. The basketball stand of claim 3, wherein the linkage means has an over-center connection to the first and second wheel assemblies.

7. The basketball stand of claim 1, wherein the linkage means includes two pairs of telescoping tube members.

8. The basketball stand of claim 1, wherein the second wheel means includes at least one pair of wheels.

9. A basketball stand comprising: a frame member for supporting a backboard and rim assembly; a base member for supporting the frame member; the frame member being pivotally mounted to the base member and moveable between a storage position and a playing position; a reciprocating actuator for displacing the frame member between the storage position and the playing position; the backboard and rim assembly being disposed along a first end portion of the base member when the frame lies in the playing position; first wheel means disposed adjacent the first end portion of the base member; second wheel means disposed adjacent a second end portion of the base member; the first wheel means being moveable between a lowered position in which the base member lies above a supporting surface to allow the basketball stand to roll over the supporting surface and a raised position in which the base member engages the supporting surface and the frame member lies in the playing position; and linkage means for connecting the first wheel means to the frame member, the linkage means transmitting the pivotal movement of the frame member to the first wheel means, the first wheel means moving to the raised position as the frame member moves to the playing position, the first wheel means moving to the lowered position as the frame member moves to the storage position.

10. The basketball stand of claim 9, wherein the first wheel means includes first and second wheel assemblies pivotally mounted to the base member, each of the first and second wheel assemblies including a rotatable caster.

11. The basketball stand of claim 9, wherein the linkage means includes two pairs of telescoping tube members.

12. The basketball stand of claim 9, wherein the second wheel means includes least one pair of wheels.

13. The basketball stand of claim 7, wherein the linkage means has an over-center connection to the first wheel means.

14. A basketball stand comprising: a frame member for supporting a backboard and rim assembly; a base member for supporting the frame member; the frame member being moveable between a storage position and a playing position; a reciprocating actuator for displacing the frame member between the storage position and the playing position; the backboard and rim assembly being disposed along a first end portion of the base member when the frame lies in the playing position; first wheel means disposed adjacent the first end portion of the base member; second wheel means disposed adjacent a second end portion of the base member; the first wheel means being moveable between a lowered position in which the base member lies above a supporting surface to allow the basketball stand to roll over the supporting surface and a raised position in which the base member engages the supporting surface and the frame member lies in the playing position; and linkage means for connecting the first wheel means to the frame member, the linkage means transmitting the movement of the frame member to the first wheel means, the first wheel means moving to the raised position as the frame member moves to the playing position, the first wheel means moving to the lowered position as the frame member moves to the storage position; the first wheel means including first and second wheel assemblies pivotally mounted to the base member, the linkage means including two pairs of telescoping tube members; the second wheel means including at least one pair of wheels.

15. A basketball stand comprising: a frame member for supporting a backboard and rim assembly; a base member for supporting the frame member; the frame member being moveable between a storage position and a playing position; a reciprocating actuator for displacing the frame between the storage position and the playing position; the backboard and rim assembly being disposed outwardly of a first end portion of the base member when the frame lies in the playing position; first wheel means pivotally mounted adjacent the first end portion of the base member; disposed adjacent a second end portion of the base member; and a linkage means pivotally connected to the frame member and the first wheel means for transmitting movement of the frame to the first wheel means.

16. The basketball stand of claim 15 wherein the first wheel means is moveable between a lowered position in which the first wheel means engages a supporting surface to allow the basketball stand to roll over the supporting surface and a raised position in which the base member engages the supporting surface and the frame member lies in the playing position.

17. The basketball stand of claim 16, wherein the first wheel means includes first and second caster assemblies pivotally mounted to the base member, each of the first and second caster assemblies including a rotatable caster.

18. The basketball stand of claim 15, wherein the linkage means includes two pairs of telescoping tube members.

19. The basketball stand of claim 15, wherein the second wheel means includes at least one pair of wheels.

* * * * *